US007475740B2

(12) United States Patent
Kozina et al.

(10) Patent No.: US 7,475,740 B2
(45) Date of Patent: Jan. 13, 2009

(54) ANGLE DRIVE ATTACHMENT

(75) Inventors: Damian A. Kozina, Rockford, IL (US); Edward D. Adkins, Loves Park, IL (US)

(73) Assignee: Nomis LLC, Hampshire, IL (US)

( * ) Notice: Subject to any disclaimer, the term of this patent is extended or adjusted under 35 U.S.C. 154(b) by 53 days.

(21) Appl. No.: 11/590,052

(22) Filed: Oct. 31, 2006

(65) Prior Publication Data

US 2007/0102178 A1 May 10, 2007

Related U.S. Application Data

(60) Provisional application No. 60/734,901, filed on Nov. 9, 2005.

(51) Int. Cl.
*B25G 3/38* (2006.01)

(52) U.S. Cl. ..... 173/216; 173/215; 173/164

(58) Field of Classification Search ..... 173/216, 173/215, 164, 217, 218, 167; 16/246; 74/396
See application file for complete search history.

(56) References Cited

U.S. PATENT DOCUMENTS 1,750,957 A * 3/1930 Fowler ..... 74/425
1,907,904 A * 5/1933 Emburg et al. ..... 451/352
2,545,659 A * 3/1951 Ginter ..... 16/426
3,783,955 A * 1/1974 Gill ..... 173/50
4,276,675 A * 7/1981 Pioch ..... 16/426
4,368,556 A * 1/1983 Wanner et al. ..... 16/436
4,441,564 A * 4/1984 Castillo ..... 175/122
4,645,388 A * 2/1987 Abrahamsen ..... 408/127
4,820,090 A * 4/1989 Chen ..... 408/241 R
4,840,082 A * 6/1989 Terashima et al. ..... 74/523
4,881,294 A * 11/1989 Riedl ..... 16/426
4,885,963 A * 12/1989 Nishikawa ..... 81/57.32
4,947,942 A * 8/1990 Lightle et al. ..... 173/216
5,188,189 A * 2/1993 Hummel ..... 173/213
5,251,706 A * 10/1993 Evans ..... 173/29
5,636,698 A * 6/1997 Estep et al. ..... 173/2
6,125,721 A * 10/2000 Yang ..... 81/57.29
6,241,594 B1 * 6/2001 Lepold ..... 451/359
6,352,127 B1 3/2002 Yorde
6,463,824 B1 10/2002 Prell et al.
6,814,156 B2 * 11/2004 Dieterle et al. ..... 173/170
6,863,479 B2 3/2005 Frauhammer et al.

(Continued)

FOREIGN PATENT DOCUMENTS

WO WO 01/81053 A1 11/2001

*Primary Examiner*—Brian D Nash
(74) *Attorney, Agent, or Firm*—Reinhart Boerner Van Deuren P.C.

(57) ABSTRACT

An angle drive attachment having an adjustable handle is provided. The angle drive includes an input shaft, an input shaft housing, a transmission, a handle mount, a handle, and an output socket. The handle allows the angle drive attachment to be adaptable to working environments having limited space or odd configurations. The input shaft rotates about the input axis of rotation and carried by the input shaft housing and drives the transmission. The output socket is connected to the transmission and rotates about an output axis of rotation and connects to a working bit. The handle mount mounts the handle to the input shaft housing. The handle, in cooperation with the handle mount, may be rotated about the input shaft housing, angled relative to the input shaft housing, and positioned axially linear along the input shaft housing.

21 Claims, 8 Drawing Sheets

U.S. PATENT DOCUMENTS

| | | | | |
|---|---|---|---|---|
| 7,052,382 | B2 | 5/2006 | Baker | |
| 7,156,187 | B1 * | 1/2007 | Townsan | 173/1 |
| 7,191,494 | B2 * | 3/2007 | Badiali | 16/426 |
| 7,191,677 | B2 * | 3/2007 | Barkdoll | 74/396 |
| 2002/0185289 | A1 | 12/2002 | Yorde, Jr. | |
| 2004/0016082 | A1 | 1/2004 | Yi | |
| 2004/0065178 | A1 | 4/2004 | Anderson et al. | |
| 2004/0159172 | A1 | 8/2004 | Barkdoll | |
| 2005/0034276 | A1 | 2/2005 | Badiali | |

* cited by examiner

ANGLE DRIVE ATTACHMENT

CROSS-REFERENCE TO RELATED PATENT APPLICATIONS

This patent application claims the benefit of U.S. Provisional Patent Application No. 60/734,901 filed Nov. 9, 2005, the entire teachings and disclosure of which are hereby incorporated in their entireties by reference thereto.

FIELD OF THE INVENTION

The present invention generally relates to rotary power tools and drill attachments and more particularly to angle drive attachments for rotary power tools and drills.

BACKGROUND OF THE INVENTION

Rotary power tools and drills are generally well known in the art. A drill has a rotary drive means typically an electric or pneumatic motor for rotating a rotary output typically an adjustable chuck. The adjustable chuck attaches drill bits, screw driver bits, or other rotating bits to the drill so that the bits may be driven by the rotary motor of the drill. Also well known in the art is an angle drive attachment that utilizes the rotary output of the drill. The angle drive attachment converts the rotary output motion of the drill which is fixed about one axis to rotary motion about another axis. These attachments allow the drill to be used in more confined work spaces. Some of these attachments will include side handles extending from the attachment to allow the user to increase the pressure applied in a direction axially parallel to the axis of rotation of the output of the right angle drive. While these devices have been satisfactory for some limited applications, prior attempts have suffered from ergonomic, versatility, size and/or durability problems. The present invention relates to improvements in angle drive attachments.

BRIEF SUMMARY OF THE INVENTION

In one aspect, an embodiment of the present invention provides an improved drive attachment for rotary power tools. The drive attachment includes an output shaft at a transmission or work end for performing a work activity. The improved drive attachment includes an adjustable handle that has an improved ergonomic and adjustable design. The handle of the drive attachment can be adjusted such that it extends outward from the attachment to provide a useful grip for applying a force to the drive attachment while the attachment is being used. Additionally, the handle can be retracted so that the drive attachment may be used in tight confined areas. The handle may be selectively positioned toward or away from the transmission end of the attachment such that the handle is close to the transmission of the attachment in open situations but the handle can be positioned away from the work end further facilitating positioning the work end within confined areas while still allowing the handle to be extended and useful. Additionally, the handle may be rotatably positioned to further increase the adaptability and ergonomics of the drive attachment. Being rotatable, the handle can be positioned so that it is easily and comfortably used by a right-handed or left-handed person.

According to a more detailed embodiment, an angle drive attachment with linear, angular and rotary adjustment of a handle relative to the transmission is provided. The angle drive attachment comprises a drive housing, an input shaft, an output shaft, a handle mount, a handle, and a clamp. The input shaft is carried in the drive housing for rotation along an input shaft axis and includes a workable end. The output shaft is carried for rotation in the drive housing about an output shaft axis that is angled relative to the input shaft axis. The output shaft includes a connector for attachment to a work bit. The handle mount is slidably mounted on the drive housing and is positionable thereon in a plurality of different linear and different angular positions. The handle extends from the handle mount. The clamp releasably secures the handle mount to the drive housing.

Another aspect of an embodiment is directed toward an angle drive attachment with selective pivoting adjustment of the handle, which may be used in combination with the aforementioned aspect. The angle drive attachment comprising a drive housing, an input shaft, an output shaft, a handle mount, a handle, and a releasable lock. The input shaft is carried in the drive housing for rotation along an input shaft axis and includes a workable end. The output shaft is carried for rotation in the drive housing about an output shaft axis that is angled relative to the input shaft axis. The output shaft includes a connector for attachment to a work bit. The handle mount is mounted to the drive housing and defines a hinge. The handle is pivotably connected to the handle mount via the hinge. The releasable lock secures the handle to the handle mount. The handle being selectively locked by the releasable lock in a plurality of different positions between fully extended and retracted positions.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF EMBODIMENTS OF THE INVENTION

Figure 1:
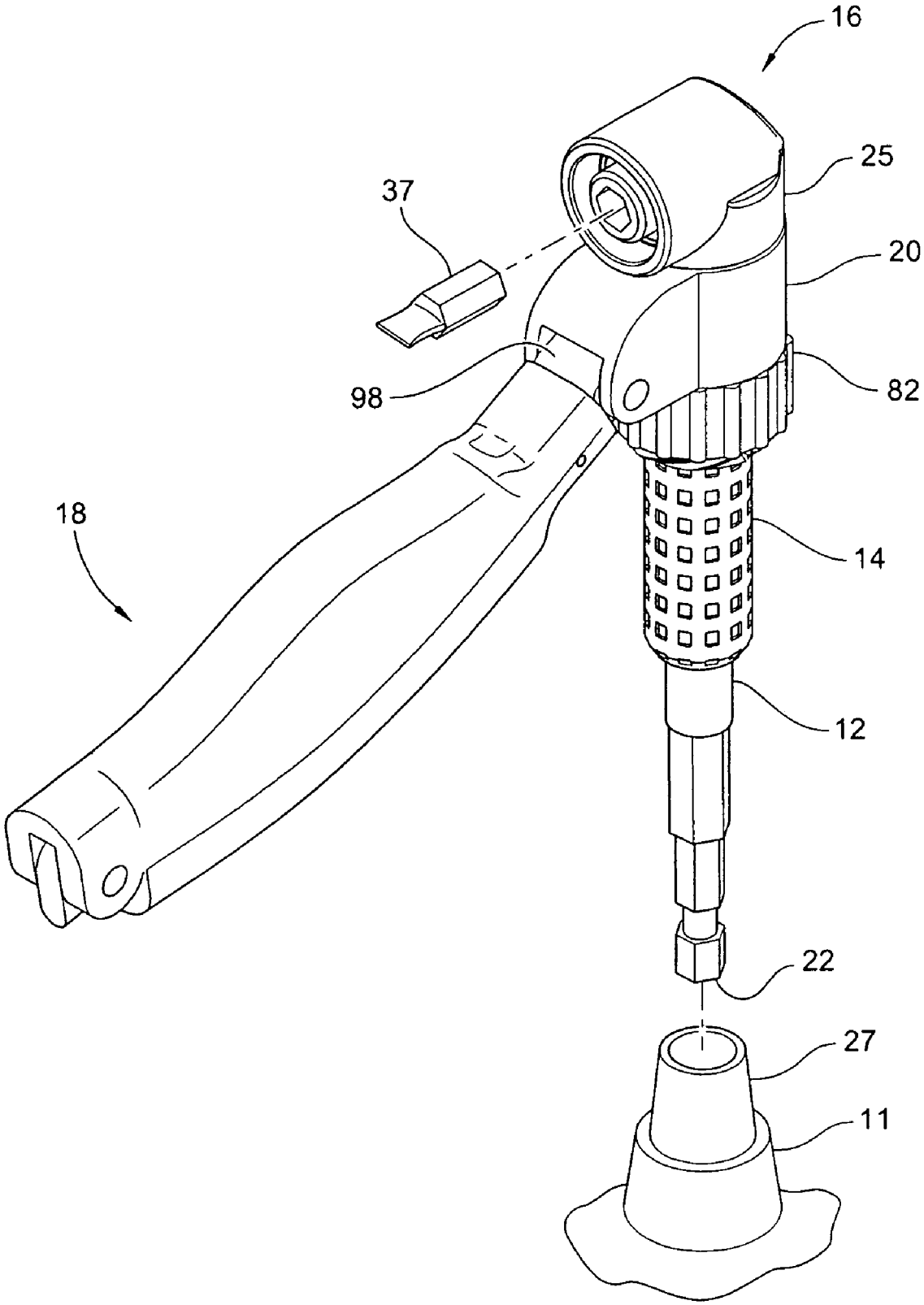
FIG. 1 is a perspective view of an exemplary embodiment of an angle drive attachment constructed in accordance with the teachings of the present invention having the handle extending from the bottom of and at an angle to the input shaft housing.
Figure 2:
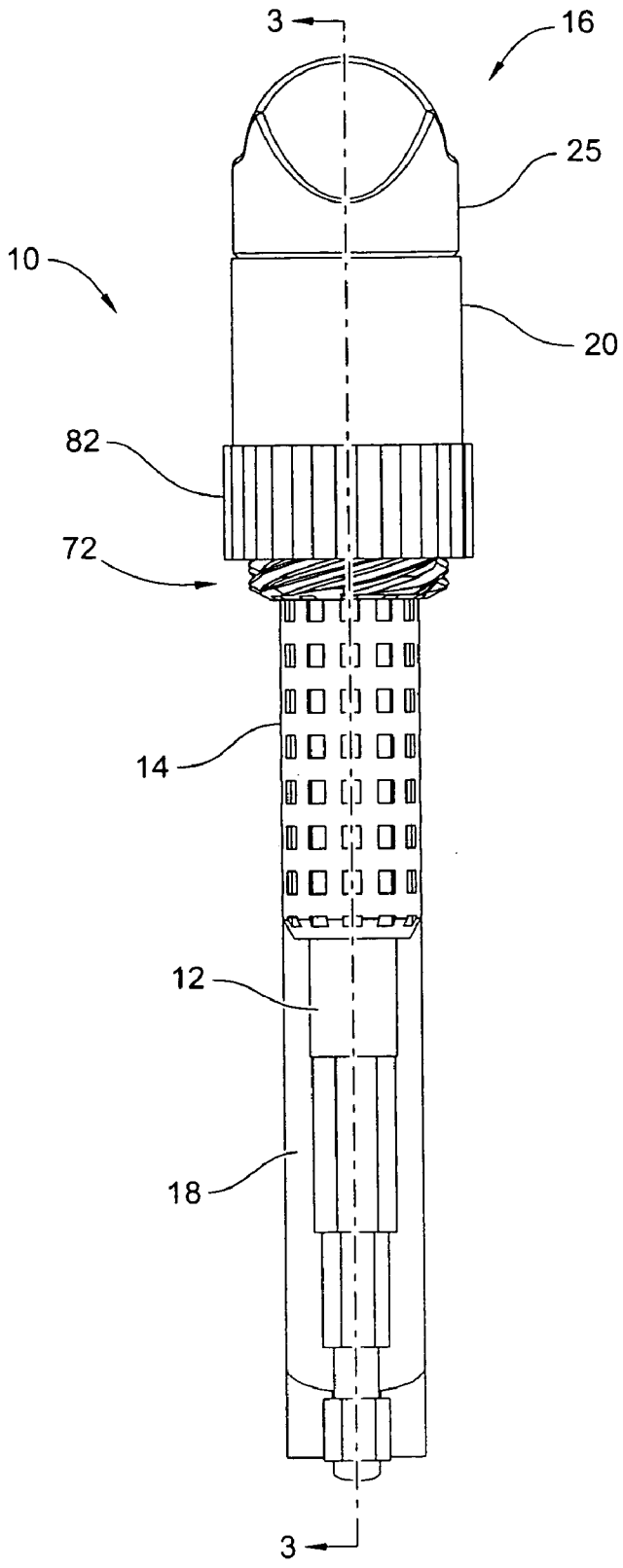
FIG. 2 is a top view of the angle drive attachment of FIG. 1.

Referring to FIG. 1, an angle drive attachment 10 for a rotary power tool is disclosed. The rotary drive attachment 10 is used in combination with a rotary power tool such as a drill 11 to vary the output axis of rotation of the tool. This is particularly useful when using the rotary power tool in confined work spaces and the typical drill configuration cannot be used in the location.

The disclosed angle drive attachment 10 generally includes an input shaft 12, an input shaft housing 14, an angle change transmission 16, a handle 18 and a handle mount 20. As best illustrated in FIGS. 4 and 5, the angle drive 10 converts rotary motion about an input axis 21 to rotary motion about an output axis 23, which is angularly spaced from the input axis, typically about 90°, but other angles can be used.

Figure 3:
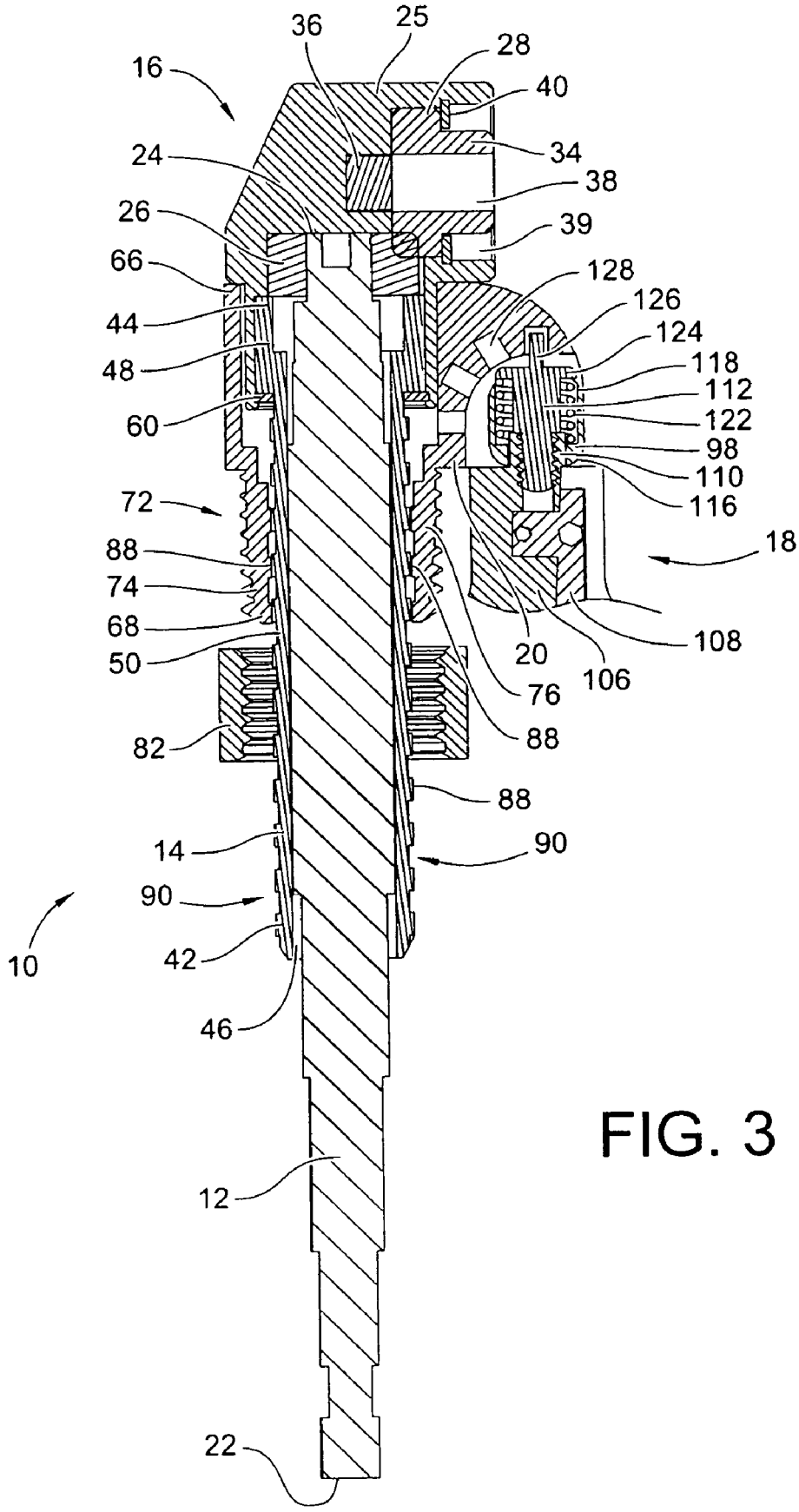
FIG. 3 is a partial cross-sectional view of the angle drive attachment of FIG. 2 about section line 3-3.
Figure 4:
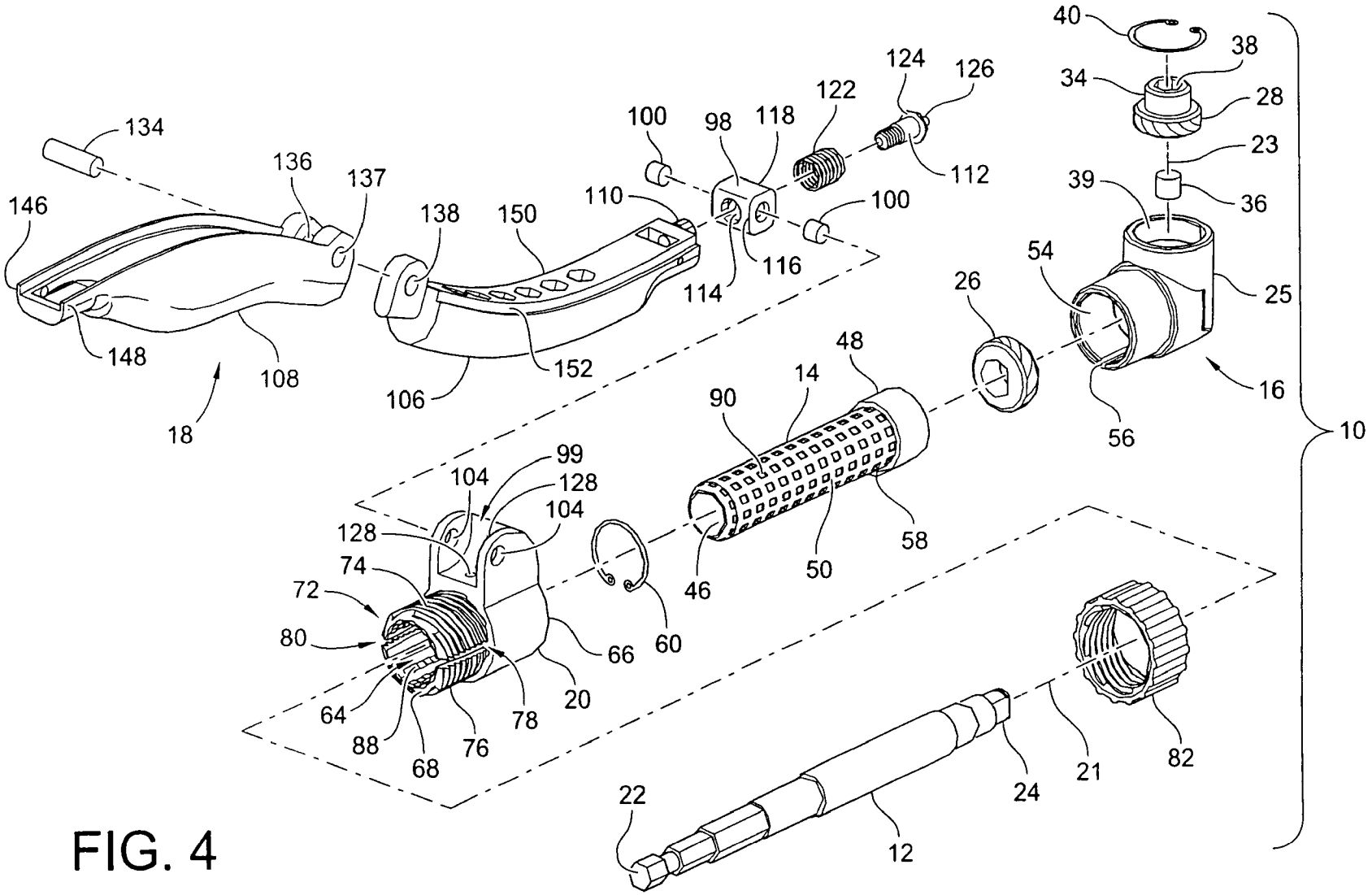
FIG. 4 is an exploded view of the angle drive attachment of FIG. 1.
Figure 5:
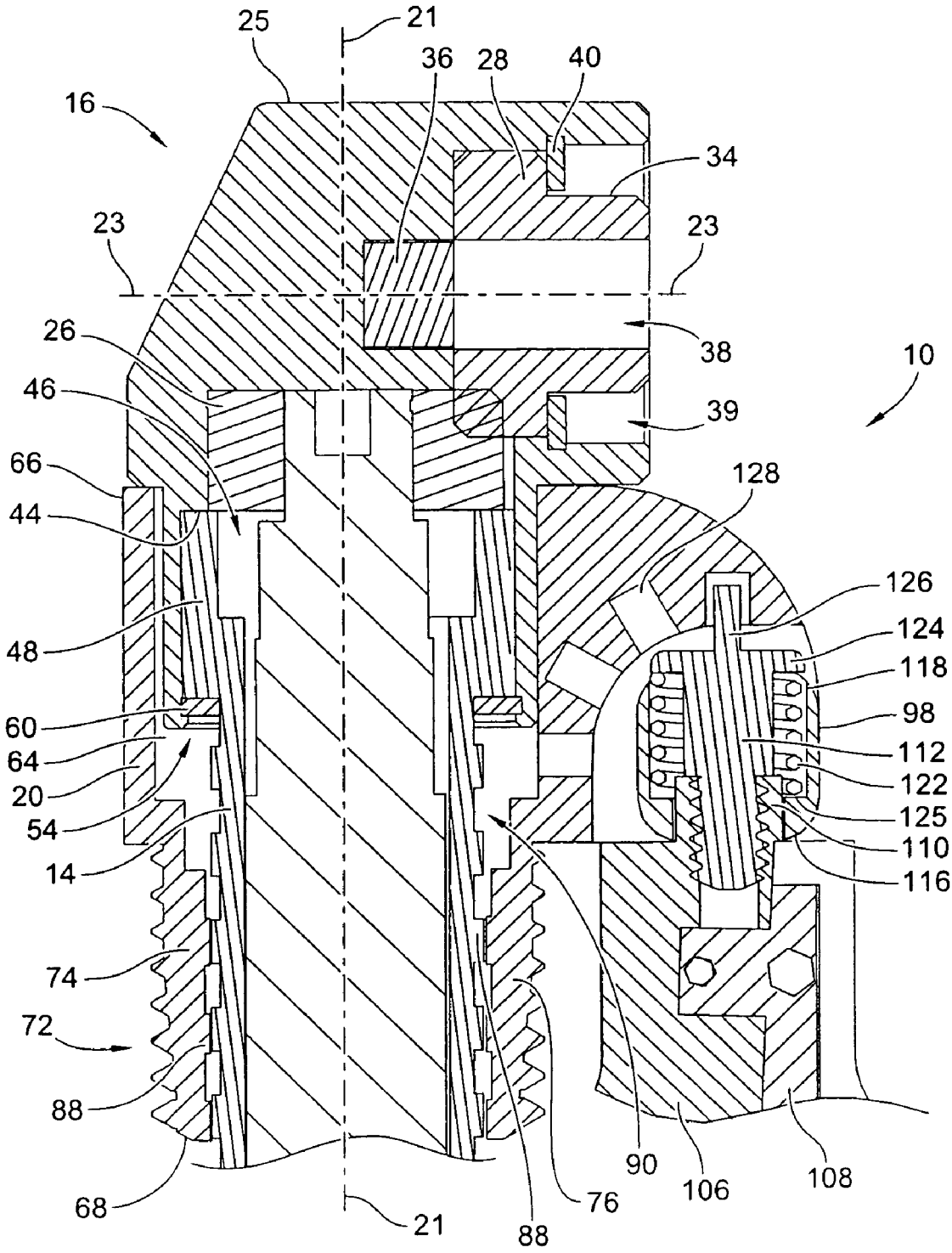
FIG. 5 is partial cross-section view of the angle drive attachment of FIG. 3.

As best illustrated in FIGS. 3-5, the input shaft 12 is carried by input shaft housing 14. The input shaft 12 extends between a first end 22 and a second end 24. The first end 22 is configured to be attached to a rotary power tool such as a drill 11 (FIG. 1) that provides a rotational input for the angle drive 10 about axis 21. Particularly, the first end 22 is configured to be receivable in a chuck 27 (FIG. 1) or connected to any other output connection device of the rotary power tool such as a socket. The second end 24 of the input shaft 12 is attached to the transmission 16.

Particularly, the input shaft 12 is inserted into the transmission housing 25 and connected to and drives input bevel gear 26 within the transmission housing 25. The input bevel gear 26 rotates about input axis 21 and drives a corresponding output bevel gear 28 located in the transmission housing 25 about output axis 23 (FIGS. 4 and 5). Typically, the bevel gears 26, 28 are tapered at approximately forty-five degrees in a cone or frustoconical shape. As the two gears mate, they change the output axis of rotation by ninety degrees. Thus, in the preferred embodiment, the input axis 21 and output axis 23 are perpendicular to each other. However, it will be appreciated that the angle drive attachment 10 could be configured such that the two axes are positioned relative to each other at various angles by changing the conical taper of the bevel gears 26, 28.

As illustrated, the input shaft 12, input bevel gear 26, and output bevel gear 28 are loosely journaled and not carried by bearings such as bushings or ball bearings. However, the input shaft, input bevel gear, and output bevel gears could be carried on such bearing devices and particularly by ball bearings to reduce friction. The use of ball bearings is particularly beneficial when using the angle drive attachment for drilling purposes.

The output bevel gear 28 is integrally connected to output socket 34 and carried on shaft 36. It will be appreciated that the output socket and bevel gear do not need to be made from a unitary piece. The output socket 34 allows the user to selectively connect the angle drive to working bits 37 such as drill bits or screw driver bits (see FIG. 1). In this embodiment, the output socket 34 has a hex socket 38 for receipt of the working bit. The hex socket 38 has a hexagonal cross-section having six sides. Furthermore, the output socket 34 may be of a magnetized material to more securely hold the working bits within the hex socket 38. Alternatively, the output socket could be an adjustable chuck. The output bevel gear 28 and integrally connected output socket 34 are retained in the output opening 39 of the transmission housing 25 by a snap ring 40.

The input shaft housing 14 is secured to the transmission housing 25 and together provide an overall drive housing. The input shaft housing 14 has a generally cylindrical shape and extends between a bottom end 42 and a top end 44. The input shaft housing 14 includes a passage 46 extending entirely through the input shaft housing 14 from the bottom end 42 to the top end 44 having a generally circular cross-section being sized to receive the input shaft 12. The input shaft housing 14 includes an enlarged end portion 48 at the top end 44 having a generally smooth outer surface. The input shaft housing 14 further includes a body portion 50 having a detented surface which comprises a plurality of cavities 90 extending axially between the enlarged end portion 48 to the bottom end 42 and around the body portion 50. The enlarged end portion 48 has a larger outside diameter than the body portion 50.

The enlarged end portion 48 is sized to be received in an input opening 54 of the transmission housing 25. The input opening 54 includes a keyway 56 in the form of groove in the side wall of the input opening 54 sized to receive an elongated corresponding key 58 that extends radially outward from the enlarged end portion 48. The key 58 extends the axial length of the end portion 48. The keyway 56 and key 58 cooperate to prevent the input shaft housing 14 from rotating relative to the transmission housing 25 about the input axis 21. A snap ring 60 inserted into the input opening 54 of the transmission housing 25 axially secures the input shaft housing 14 into the transmission housing 25.

As best illustrated with reference to FIGS. 3-6, the handle mount 20 is selectively connected to and positioned relative to the input shaft housing 14. The input shaft housing 14 is inserted through a passage 64 in the handle mount 20. The bottom end 42 of the input shaft housing 14 is inserted into the passage 64 at a top end 66 of the handle mount 20 and exits the passage 64 at a bottom end 68 of the handle mount 20.

The handle mount 20 includes a radially expandable and retractable cylindrical clamp 72 for securing the handle mount 20 to the body portion 50 of the input shaft housing 14. The clamp 72 is made of resilient material and includes two clamp portions 74, 76 that have a C-shaped cross-section and have a threaded outer surface. The clamp portions 74, 76 are tapered such that the threaded outer surface has a varying radius relative to input axis 21. Particularly, the radius of the outer surface increases moving in a direction from the bottom end 68 to the top end 66 of the handle mount 20. The clamp portions 74, 76 are separated from one another by slots 78, 80 to allow for radially inward and outward flexing movement. A locking collar 82 that is internally threaded screws onto the clamp portions 74, 76 to tighten the clamp 72 around and to the body portion 50 of the input shaft housing 14. As the locking collar 82 is threaded onto the clamp 72, the locking collar 82 resiliently biases and compresses the two clamp portions 74, 76 radially inward and towards each other decreasing the inner diameter of passage 64 such that the clamp portions 74, 76 tighten around the input shaft housing 14. Alternatively, the locking collar could be tapered and the clamp portions have a constant radius or the inside diameter of the locking collar could be sufficiently small relative to the outside diameter of the clamp 72 such that the clamp portions would be sufficiently resiliently biased towards one another.

The clamp portions 74, 76 include a corresponding detented region in the form of a plurality of bumps 88 for selectively engaging a portion of a corresponding plurality of cavities 90 in the outer surface of the body portion 50 of the input shaft housing 14. The bumps 88 and cavities 90 engage to prevent the handle mount 20 from rotating about or axially sliding relative to the input shaft housing 14.

The clamp 72 and locking collar 82 define a loosened condition in which the locking collar 82 is threaded towards the bottom end 68 of the handle mount 20 such that the clamp portions 74, 76 are spread apart and the bumps 88 are disengaged from the cavities 90 as shown in FIG. 3. A tightened condition is defined in which the locking collar 82 is threaded towards the top end 66 of handle mount 20 squeezing the clamp portions 74, 76 towards one another such that the bumps 88 engage the cavities 90. It will be appreciated that in the loosened condition the handle mount 20 may be selectively attached to the input shaft housing 14 in various axial or rotational orientations.

Figure 9:
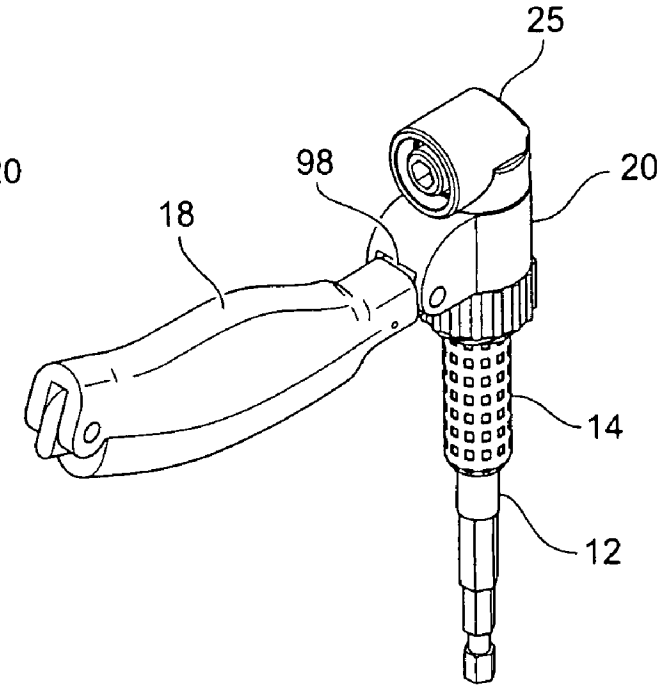
FIG. 9 is a perspective view of the angle drive attachment of FIG. 1 having the handle extending substantially perpendicular to the input shaft and input shaft housing.
Figure 8:
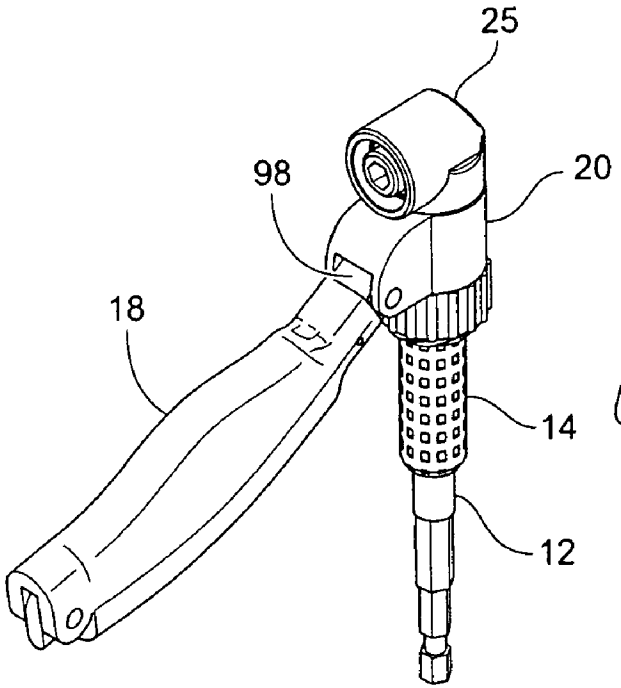
FIG. 8 is a perspective view of the angle drive attachment of FIG. 1 having the handle extending from the handle mount at an angle relative to the input shaft and input shaft housing.
Figure 7:
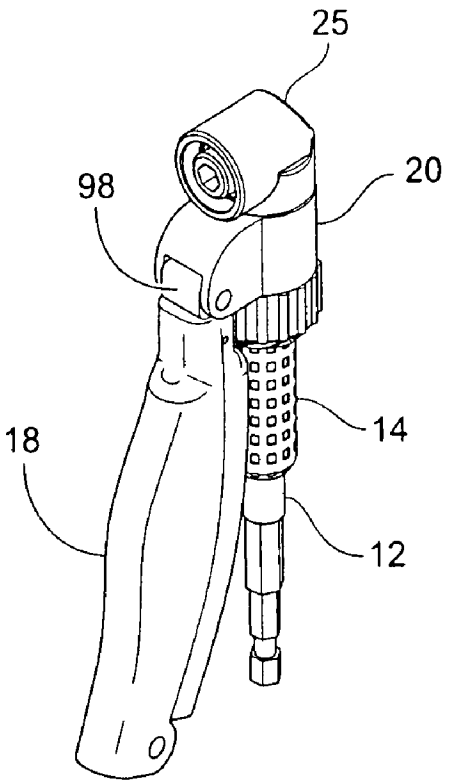
FIG. 7 is a perspective view of the angle drive attachment of FIG. 1 having the handle substantially parallel to the input shaft and input shaft housing.

The handle mount 20 attaches the handle 18 to the input shaft housing 14 and is configured such that the handle may selectively extend outward from the input shaft housing 14 at various angles, as shown in FIGS. 7-9.

Figure 6:
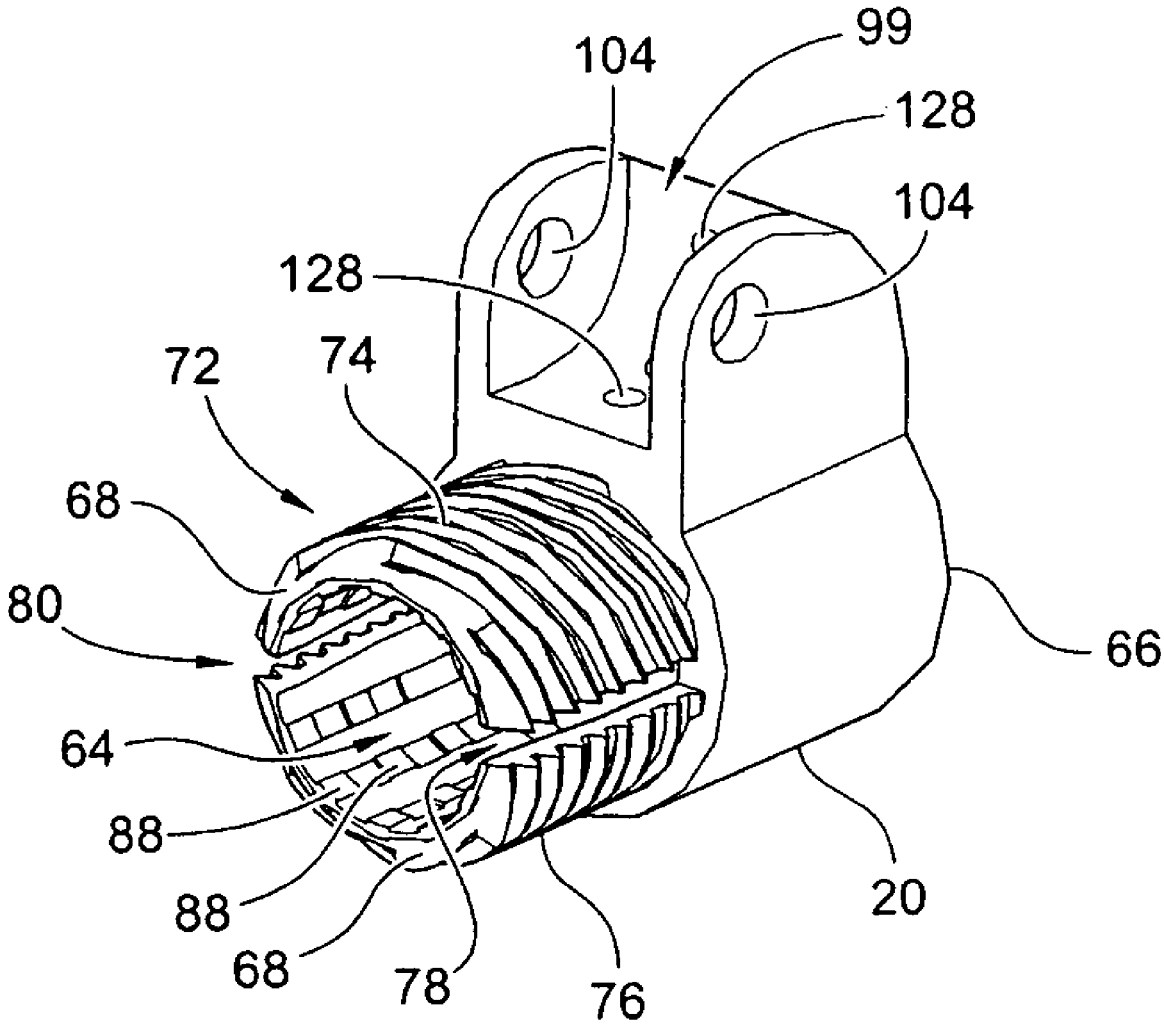
FIG. 6 is a perspective view of the handle mount of the angle drive attachment of FIG. 1.

Referring to FIGS. 4-6, the handle 18 is pivotally attached relative to the handle mount 20 through knuckle 98 that is hingedly secured in slot 99 of the handle mount 20. Hinge pins 100 insert into holes 102 on opposite ends of knuckle 98 as well as holes 104 in the handle mount 20 pivotally secure the knuckle 98 in the slot 99 of the handle mount 20. The handle 18, which includes first and second handle portions 106, 108, is attached to the knuckle 98 via shaft 110 extending from an end of the first handle portion 106 and a lock pin 112 that threads into the shaft 110. The shaft 110 is slidingly received into an aperture 114 in the knuckle 98 from a bottom side 116 of the knuckle 98. The lock pin 112 is slidingly inserted into the aperture 114 from a top side 118 of the knuckle 98 and screwed into the shaft 110 to secure the handle to the knuckle 98. The aperture 114 has a hexagonal cross-section and the outer surface of the shaft 110 has a corresponding hexagonal cross-section. This configuration prevents the handle 18 from rotating within the aperture 114 and relative to the knuckle 98.

A spring 122 positioned between an abutment shoulder 124 extending radially outward from the lock pin 112 and an interior abutment surface 125 of the knuckle 98 biases the lock pin 112 away from the knuckle 98. As the lock pin 112 is biased away from the knuckle 98, the shaft 110 is pulled into aperture 114. The handle 18 can be pulled away from the knuckle 98 compressing the spring 122 such that the lock pin 112 is pulled through the aperture 114 in a direction extending from the top side 118 to the bottom side 116 of the knuckle.

The lock pin 112 includes an axially projecting finger 126 for selectively positioning the handle 18 relative to the handle mount 20. Particularly, slot 99 includes a plurality of cavities 128 sized to receive the finger 126 for selectively determining the angle at which the handle 18 extends from the handle mount 20 relative to the input shaft housing 14. To change the angular position of the handle 18, the user pulls on the handle 18 in a direction away from the knuckle 98 thereby pulling the finger 126 towards the knuckle 98 and away from the cavity 128 in which it is inserted thereby defining an adjustment condition. The handle 18 is then rotated relative to the handle mount 20 via the knuckle 98 that is hingedly connected to the handle mount 20. The handle 18 is then released such that the spring 122 would bias the handle 18 towards the knuckle 98 thereby forcing the lock pin 112 way from the knuckle 98 such that the finger 126 reengages one of the cavities 128 defined in the slot 99 of the handle mount 20.

By being attached to the input shaft housing 14 via the handle mount 20, the position and orientation of the handle 18 relative to the transmission housing 25 can be substantially altered such that the angle drive attachment can be used in work spaces having various configurations and impediments. First, with reference to FIGS. 1 and 3, the handle 18 may be slid axially along the input shaft housing 14 towards the top end 44 or towards the bottom end 42 to position the handle towards or away from the transmission housing 25, respectively.

Second, the handle 18 and handle mount 20 may be completely rotated about the input shaft housing 14. This feature can be beneficial for more than being used in tight working conditions. This allows the angle drive attachment to be easily adapted to a right handed person or a left handed person, as well as, to minimize the area required for storage. It will be appreciated that the handle 18 will be generally rotated about the input shaft housing 14 such that the handle 18 will be positioned to the side of the input shaft housing 14.

Third, as explained previously, the handle 18 can be selectively pivoted via the knuckle 98 to adjust the angle the handle 18 makes with the input shaft housing 14. This includes being perpendicular to the input shaft housing 14 as shown in FIG. 9, parallel to the input shaft housing 14 as shown in FIG. 7, and intermediate positions as shown in FIG. 8. The parallel position (FIG. 7) is used in very tight conditions as well as being the best position for storage. The perpendicular position FIG. 9 is most preferable during use, unless the handle 18 would be obstructed by the working environment.

Figure 10:
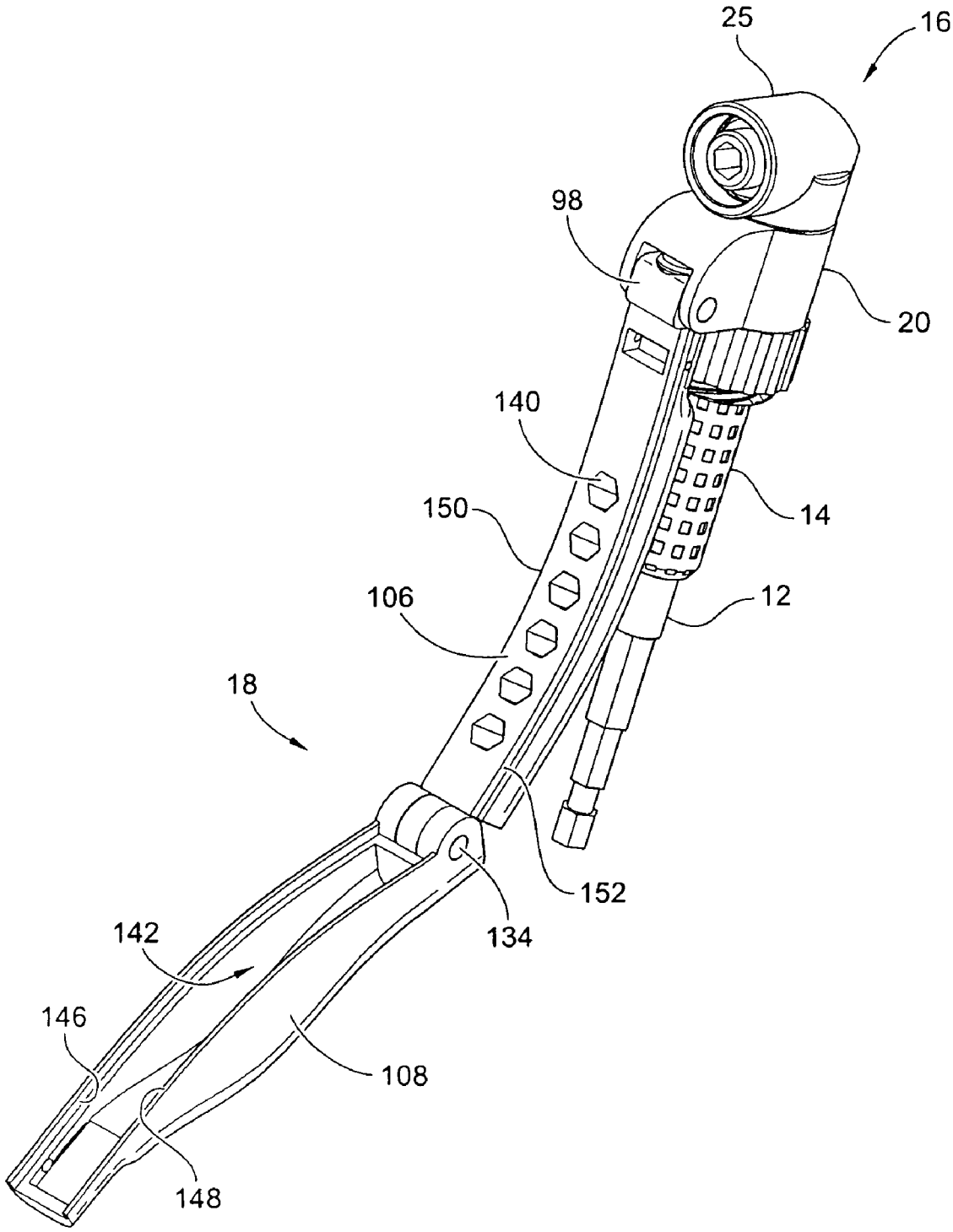
FIG. 10 is a perspective view of the angle drive attachment of FIG. 1 having the handle in an open position showing the working bit storage compartment.

It is a further feature of the handle 18 that it includes a storage compartment for working bits, as shown in FIG. 10. To define the storage compartment, the first handle portion 106 is hingedly connected to the second handle portion 108 by hinge pin 134. Hinge pin 134 is inserted through two apertures 136, 137 in the second handle portion 108 and aperture 138 in the first handle portion 106 (see FIG. 4). As shown in FIG. 10, the first handle portion 106 includes a plurality of cavities 140 for receiving working bits. In the preferred embodiment, the cavities 140 have a hexagonal shape sized for snug fit receipt of one end of a working bit. The cavities 140 extend only partially through the thickness of the first handle portion 106. The second handle portion 108 includes a large storage compartment 142 that covers the other end of the working bits when in a closed position securing the working bits within the handle 18.

The second handle portion 108 includes two side walls 146, 148 that overlap corresponding shoulder portions 150, 152 of the first handle portion 106. Preferably, the side walls 146, 148 overlap with shoulder portions 150, 152 snuggly with a snap fit or friction fit such that the second handle portion 108 cannot be easily pivotally opened relative to the first handle portion 106 thereby preventing the handle portions 106, 108 from easily separating and allowing the working bits to fall out.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An angle drive attachment, comprising:

a drive housing;

an input shaft carried for rotation in the drive housing for rotation along an input shaft axis, the input shaft having a workable end;

an output shaft carried for rotation in the drive housing for rotation along an output shaft axis that is angled relative to the input shaft axis, the output shaft having a connector for attachment to a work bit;

a handle mount mounted to the drive housing;

a handle pivotably connected to the handle mount via a hinge;

a releasable lock securing the handle to the handle mount, the handle being selectively locked by the releasable lock in one of a plurality of different positions between fully extended and retracted when the releasable lock is in a locked position and the handle being pivotable through the hinge when the releasable lock is in an unlocked position; and wherein the releasable lock is unlocked by axially pulling the handle allowing the handle to be pivotably repositioned to one of the different positions via the hinge.

2. The angle drive attachment of claim 1, wherein the releasable lock includes a locking pin that releasably engages a selected one of a plurality of locking cavities.

3. The angle drive attachment of claim 2, further comprising a biasing member biasing the locking pin toward engagement with the selected locking cavity.

4. The angle drive attachment of claim 3, wherein the biasing member is a coil spring compressed between the locking pin and the knuckle.

5. The angle drive attachment of claim 2, further comprising a knuckle pivotally mounted to the handle mount providing the hinge, the knuckle slidingly supporting the handle.

6. The angle drive attachment of claim 5, wherein the handle is slidable in a direction transverse to an axis of rotation of the knuckle.

7. The angle drive attachment of claim 5, further comprising a biasing member biasing a grip portion of the handle toward the knuckle and an engagement portion of the locking pin away from the knuckle and toward engagement with the selected locking cavity.

8. The angle drive attachment of claim 2, wherein the plurality of cavities are angularly spaced apart relative to an axis of rotation of the hinge.

9. The angle drive attachment of claim 1, wherein the releasable lock and handle are configured such that pulling on the handle releases the releasable lock allowing the handle to be repositioned to one of the different positions between fully extended and fully retracted and releasing the handle locks the handle in the selected position.

10. An angle drive attachment, comprising:

a drive housing;

an input shaft carried for rotation in the drive housing for rotation along an input shaft axis, the input shaft having a workable end;

an output shaft carried for rotation in the drive housing for rotation along an output shaft axis that is angled relative to the input shaft axis, the output shaft having a connector for attachment to a work bit;

a handle mount releasably mounted to the drive housing, the handle mount being positionable and securable relative to the drive housing in a plurality of different axial positions along an axis and the handle mount being positionable and securable relative to the drive housing in a plurality of different angular positions about the axis; and a handle extending from the handle mount.

11. The angle drive attachment of claim 10, further comprising:

a clamp releasably securing the handle mount to the drive housing.

12. The angle drive attachment of claim 11, further comprising a locking collar threadedly engaging the clamp, wherein the locking collar compresses the clamp against the drive housing.

13. The angle drive attachment of claim 12, wherein at least one of the locking collar and the clamp is tapered such that relative rotation between the locking collar and the clamp in at least one direction increasingly compresses the clamp.

14. The angle drive attachment of claim 12, wherein either the drive housing or the clamp includes a detented region and the other one of the drive housing and clamp includes a corresponding at least one engagement bump configured to selectively mate with the detented region to selectively prevent movement of the handle mount relative to the drive housing.

15. The angle drive attachment of claim 12, wherein the handle mount and clamp are integrally formed in a single unitary body, the handle mount projecting radially outward from the clamp, the clamp including a solid cylindrical portion and a threaded stub portion with axially extending slits therein, the thread stub portion receiving the locking collar.

16. The angle drive attachment of claim 15, wherein the solid cylindrical portion is of a larger diameter than the threaded stub portion, the solid cylindrical portion is supported for rotation by a cylindrical bearing surface of the drive housing, the unitary body is further axially movable relative to the drive housing, and further including means between the threaded stub portion and the drive housing for detentably locking the clamp to the drive housing.

17. The angle drive attachment of claim 11, further having the handle pivotally connected to the handle mount, the handle having a locking pin that engages a selected one of a plurality of angularly spaced apart locking cavities of the handle mount in an engaged position preventing pivotal movement of the handle relative to the handle mount and that is disengaged from the locking cavities in a released position allowing pivotal movement of the handle relative to the handle mount.

18. The angle drive attachment of claim 17, further comprising a biasing member resiliently biasing the locking pin toward engagement with the selected locking cavity.

19. The angle drive attachment of claim 18, wherein the biasing member and handle are arranged such that pulling on the handle acts against the biasing member and removes the locking pin from the selected locking cavity and releasing the handle allows the locking pin to insert into the selected locking cavity

20. The angle drive attachment of claim 19, further comprising a knuckle pivotally connected to the handle mount providing the pivotal connection between the handle and handle mount, the knuckle slidingly supporting the handle such that pulling on the handle slides the handle relative to the knuckle to remove the locking pin from the locking cavity.

21. The angle drive attachment of claim 20, wherein the handle includes at least one cavity housing at least one work bit.

* * * * *